United States Patent [19]

Shevchuk

[11] 4,157,856

[45] Jun. 12, 1979

[54] UNITARY STRUCTURE FLEXIBLE RETAINING CLIP

[75] Inventor: George J. Shevchuk, Old Bridge, N.J.

[73] Assignee: Bell Telephone Laboratories, Incorporated, Murray Hill, N.J.

[21] Appl. No.: 904,470

[22] Filed: May 10, 1978

[51] Int. Cl.[2] ..... A44B 21/00; H01B 17/16; H01R 13/54

[52] U.S. Cl. ..... 339/75 R; 24/73 PB; 174/138 G; 339/91 R; 339/103 R

[58] Field of Search ..... 339/75 R, 75 M, 75 P, 339/91 R, 103 R, 104, 120; 174/138 G; 24/73 PB, 73 AP; 248/500, 505

[56] References Cited

U.S. PATENT DOCUMENTS

| | | | |
|---|---|---|---|
| 3,126,184 | 3/1964 | Kropp | 24/73 PB |
| 4,043,627 | 8/1977 | Ayer | 339/91 R X |
| 4,076,204 | 2/1978 | Kalka | 339/91 R X |
| 4,083,523 | 4/1978 | Fisher | 24/73 AP X |
| 4,099,819 | 7/1978 | Keglewitsch | 339/91 R X |
| 4,121,880 | 10/1978 | Rollins et al. | 339/104 X |

*Primary Examiner*—Roy Lake
*Assistant Examiner*—E. F. Desmond
*Attorney, Agent, or Firm*—David H. Tannenbaum

[57] ABSTRACT

There is disclosed a flexible unitary retaining clip for use with two part electrical connectors. The clip locks around the mated connector by the snap action of folded sections and is released by externally directed outward pressure on a top section. The clip is designed with two mounting positions to accommodate different connector hood sizes.

11 Claims, 5 Drawing Figures

UNITARY STRUCTURE FLEXIBLE RETAINING CLIP

TECHNICAL FIELD

This invention relates to a retaining clip for use with multipart connectors and more particularly to a unitary retaining clip for holding the connectors in mated relationship.

BACKGROUND

It has become common practice to mount one part of a multipart electrical connector to a mounting panel and to detachably mate a second part of the connector with the first part. When the two parts are mated it is usually desired that they remain so for long periods of time. To accomplish such a result reliance is usually made upon the combined insertion-extraction forces of the individual electrical contacts of the connectors. However, in some applications it is desired to use a positive locking force to insure that the two parts of the connector remain mated until manually released.

To compound the problem several other considerations must be considered. In actual practice it is desired to mount the connectors in close proximity to each other and thus bulky locking arrangements are not acceptable. A second consideration is that the cable hoods of the various connectors have at least two differing heights and thus when it is desired to interchange connectors having different size hoods the locking mechanism must be able to accept the different size with a minimum of effort and, if possible, without requiring removal of the permanently mounted connector portion. Still a third constraint is that the locking mechanism must be inexpensive to manufacture.

These and other objects and problems are solved by a retaining clip which is a simple molded plastic part and designed with folding sections which snap tight around the mated connector housing. The clip is molded with thin live plastic hinges and may be opened from the top by a positive outward movement of one of the folded sections. Until the top section is manually released the clip asserts inward pressure on the mated connector portions thereby insuring their continued mated relationship. Since the retaining clip is constructed from thin plastic and releasable from the outside of the top section the connectors can be secured on close centers. An adjustment is provided at the base of the clip for adjusting the height of the clip to accommodate the different size hoods anticipated.

DESCRIPTION OF THE DRAWING

The construction and utilization of the present invention will be more apparent from the following description taken in conjunction with the drawing in which.

DETAILED DESCRIPTION

Figure 1:
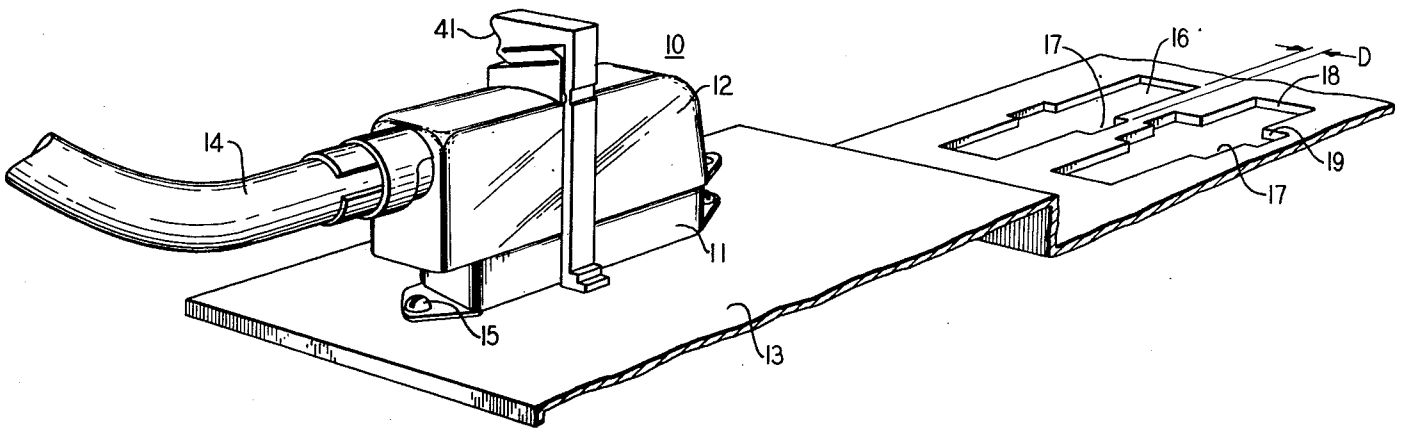
FIG. 1 shows a mated connector being restrained by a retaining clip.

In FIG. 1 there is shown a two part connector having a first part 11 and a second part 12 mated together with part 11 affixed to panel 13 in a cutout, such as cutout 16. Electrical cable 14 is shown extending from the hood portion of part 12 of the connector. This multipart connector is of a type well known in the art, such as, for example, the series 57 microribbon connectors manufactured by Amphenol Incorporated.

The individual wires of cable 14 terminate in pins (or sockets) inside part 12 of the connector which pins mate on an individual basis with sockets mounted in part 11 of the connector. Part 11 is attached to panel 13 by screws, rivets or other mounting devices 15.

Retaining clip 10 is shown locked tight around the mated multipart connector and applies positive inward pressure on the mated connector. Outwardly directed force from the inside of the clip will not release the clip. However, upwardly directed movement of retaining clip 10 at edge 41 will cause the clip to open.

Figure 3:
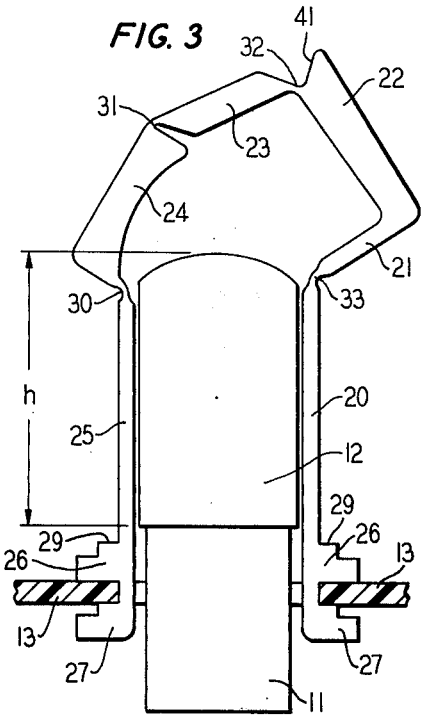
FIG. 3 shows a side view of a retaining clip opened for release of a connector.
Figure 4:
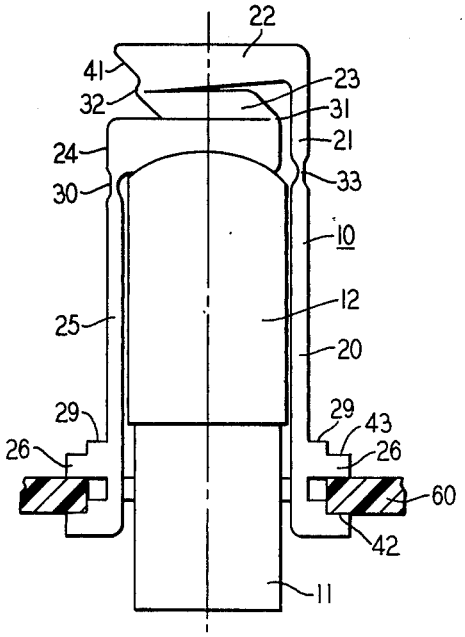
FIG. 4 shows a side view of a retaining clip locked against a connector.

A typical cutout 16 is shown having cutout areas 17 in which retainer clip 10 will fit as shown in schematic form in FIGS. 3 and 4. Cutout 18 is shown having a widened portion of cutout 17 for removal of the clip in the manner to be discussed.

Figure 2:
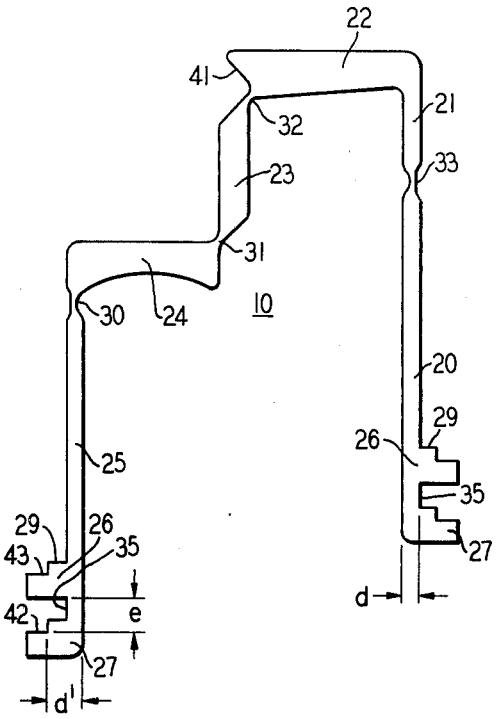
FIG. 2 shows a side view of a retaining clip as molded.

Turning now to FIG. 2, retaining clip 10 is constructed from thin live plastic, such as polypropylene or plasticized PVC with knees or hinges 30, 31, 32, 33 formed in the walls of the unitary structure. Thus clip 10 is manufactured as a single unit obviating the need for assembly.

Figure 5:
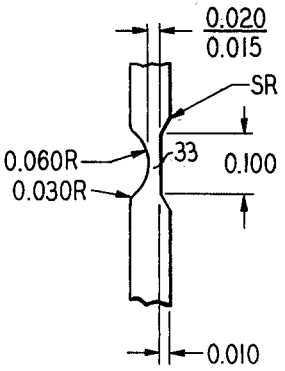
FIG. 5 shows a detailed view of one of the hinges of the retaining clip.

FIG. 5 shows a typical cross section of one type of a hinge or knee with the dimensions shown being typical for one embodiment of the retaining clip. It is, of course, understood that many such dimensions and hinge constructions can be utilized to advantage with different dimensions used for different hinges on the same clip depending on the degree of bending required. As will be shown, hinges 31 and 32 are called upon to flex further than hinges 30 and 33 and thus could be constructed differently.

Returning to FIG. 2, the ends of retaining clip 10 has projections 26 and 27 which define a section 35 with the width of section 35 being slightly larger than the thickness of panel 13, so that as shown in FIGS. 3 and 4, retaining clip 10 can be mounted into the panel and retained therein in an upward or perpendicular posture with respect to the panel.

When it is desired to use a connector having a hood 12 which has a height h which is less than the height shown, then retaining clip 10 would be moved downward so that surface 29 of projection 26 is in contact with the bottom surface of panel 13. By constructing the cutout, as shown by cutout 18, FIG. 1, with a deeper cutout portion 19 adjacent to slot 17, it is possible to slide retaining clip 10 toward the deeper cutout and move it up or down through the panel to adjust the height of the connector to accommodate differing hood sizes without removing connector portion 11. The clip can also be removed via the deeper cutout. Note that the depth D of slot 17 is constructed to be approximately the same size as the thickness d of the wall of retaining clip 10, as shown in FIG. 2. In the event that the mounting panel thickness is greater than that allowed by the opening 35, such as a plastic panel (panel 60, FIG. 4) slot 17 must be deeper such that D is approximately the same as d' (FIG. 2). Then surface 42 or 43 is in contact with the bottom surface of panel 60.

In FIG. 4, retaining clip 10 is shown in a locked position such that sections 20 and 25 extend upward from the panel a distance approximately equal to the height h of hood 12. Connected by hinge 30 to section 25 is inner section 24 having an inside surface of the same geometric shape as the upper surface of connector hood 12. The outer surface of section 24 is relatively flat. Connected to section 24 by hinge 31 is middle section 23, which, in the locked position, is folded back across the top of section 24 and positioned over the center of hood 12. Connected to section 23 by hinge 32 is outside section 22 which folds back across section 23, again passing over the center of hood 12. Section 22 is constructed with an approximate right angle section 21 and connects by hinge 33 to section 20. Thus, as shown in FIG. 4, when the two parts of the connector are in mated relationship the sections of retaining clip 10 may be folded in such a manner that continuous inward pressure is exerted on hood 12 serving to maintain the connector in a mated position. This position provides a locked barrier to the removal of connector part 12.

The selection of the lengths of sections 20 through 24 are such that the clip continues, as shown in FIG. 4, to insert inward force until such time as outward and upward pressure is exerted on lip 41.

In one embodiment section 20 is nominally $1\frac{1}{4}''$ (3.5 cm.), section 21 is $\frac{1}{2}''$ (1.27 cm.), section 22 is $\frac{3}{4}''$ (1.9 cm.) section 23 is $\frac{5}{8}''$ (1.6 cm.), section 24 is $\frac{5}{8}''$ (1.6 cm.), and section 25 is $1\frac{1}{4}''$ (3.5 cm.).

Outward pressure causes retaining clip 10 to unfold as shown in FIG. 3, thereby forming an archway large enough for the removal of connector hood 12 from connector part 11.

What is claimed is:

1. A retaining clip for use with a multipart connector where a first portion of the connector is affixed to a panel and a second portion of the connector is detachably matable to said first portion, said retaining clip arranged for maintaining said first and second portions of said connector in said mated relationship, said retaining clip characterized in that there comprises molded end portions for positioning said retaining clip with respect to said panel, said retaining clip being a unitary structure having a plurality of flexible knees molded therein, said knees separating segments of said retaining clip, a first clip segment disposed next adjacent to one of said molded end portions, a second clip segment disposed next adjacent to the other of said molded end portions, said first and second segments constructed to be substantially the same length as the distance between said panel and the top surface of said second portion of a mated connector, and other segments of said structure positioned between said first and second segments and disposed about said flexible knees, and other segments arranged to fold upon themselves at said knees, said folds bringing at least two of said segments over a center line of said top of a mated second connector portion to form a locked barrier around said mated connector.

2. The invention set forth in claim 1 wherein one of said segments includes a molded section for applying outwardly directed pressure so as to release said locked barrier.

3. The invention set forth in claim 2 wherein a first one of said folded other segments has an inside surface curved to mate with the curved top surface of said second portion of said connector, and an outside surface which is relatively flat.

4. The invention set forth in claim 2 wherein said other segments comprise an inner segment, a middle segment and an outer segment, said inner segment positioned next adjacent said first segment having an inner surface curved to mate with the curved top surface of said second portion of said mated connector, and an outside surface which is relatively flat, said middle segment having relatively flat inner and outer surfaces, said inner surface arranged to mate with said outside surface of said inner segment, said outer segment constructed as a permanent angle, having a first portion the inside surface of which mates with said outside surface of said middle segment, and a second portion substantially perpendicular to said first portion, said second portion positioned next adjacent said second segment, and wherein all of said mating relationships are defined when said retaining clip is folded to form said locked barrier around a mated connector.

5. The invention set forth in claim 4 wherein said outwardly directed pressure-applying molded section is included in an outer surface of said outer segment.

6. A retaining clip for use with a multipart connector where a first portion of the connector is affixed to a panel and a second portion of the connector is detachably matable to said first portion, said retaining clip arranged for maintaining said first and second portions of said connector in said mated relationship, said retaining clip characterized in that there comprises first and second identical end portions for positioning said retaining clip with respect to said panel, a first segment, rigidly affixed at a first end thereof to said first end portion, said first segment having a length substantially equal to the height of said second portion of a mated connector, a second segment flexibly affixed at a first end thereof to a second end of said first segment, said second segment having an inner surface curved to mate with the curved top surface of said second portion of said mated connector, a third segment flexibly connected at a first end thereof to a second end of said second segment, a fourth segment flexibly affixed at a first end thereof to a second end of said third segment, said fourth segment having a first portion disposed next adjacent said last-mentioned flexible connection and a second portion rigidly affixed to said first portion and disposed perpendicular to said first portion, a fifth segment flexibly affixed at a first end thereof to said fourth segment at a second end of said fourth segment, said second portion of said fourth segment being disposed next adjacent said last-mentioned flexible connection, said fifth segment having a length approximately equal to said first segment and rigidly affixed at a second end thereof to said second end portion.

7. The invention set forth in claim 6 wherein said retaining clip is a unitary structure having said flexible connections integral thereto.

8. The invention set forth in claim 7 wherein said flexible connections include areas of said unitary structure having a reduced cross-section from the cross-section of said segments.

9. The invention set forth in claim 8 wherein said first and second end portions each include a pair of protrusions defining a support area, said support area having an opening wide enough to accept said panel.

10. The invention set forth in claim 6 wherein said second, third and fourth segments are arranged to fold upon themselves over a center line of a mated connector when said clip is positioned in a panel, said segments further arranged such that when so folded against a mated connector a locked barrier is formed around said mated connector, said barrier remaining locked against force applied outwardly from the inside of said barrier.

11. The invention set forth in claim 10 wherein said fourth segment includes at said first end thereof a projection for allowing outward force to be applied to said fourth segment, said outward force serving to unfold said segments thereby opening said locked barrier.

* * * * *